US008695825B2

(12) United States Patent
Oksnevad

(10) Patent No.: US 8,695,825 B2
(45) Date of Patent: Apr. 15, 2014

(54) COUNTERWEIGHTED CONTAINER LATCH

(75) Inventor: Kjell Magne Oksnevad, Sandnes (NO)

(73) Assignee: M-1 LLC, Houston, TX (US)

( * ) Notice: Subject to any disclaimer, the term of this patent is extended or adjusted under 35 U.S.C. 154(b) by 864 days.

(21) Appl. No.: 11/681,495

(22) Filed: Mar. 2, 2007

(65) Prior Publication Data

US 2007/0210079 A1 Sep. 13, 2007

Related U.S. Application Data

(60) Provisional application No. 60/778,787, filed on Mar. 3, 2006.

(51) Int. Cl.
*B65D 21/032* (2006.01)
*B65D 43/16* (2006.01)

(52) U.S. Cl.
USPC ..... 220/23.83; 220/828; 220/264; 220/380; 206/509; 206/508

(58) Field of Classification Search
USPC ..... 220/828, 831, 832, 262, 263, 264, 380, 220/23.83; 206/503, 508–510; 222/556
See application file for complete search history.

(56) References Cited

U.S. PATENT DOCUMENTS

| | | | | |
|---|---|---|---|---|
| 1,115,346 | A * | 10/1914 | Stiles | 220/262 |
| 1,300,710 | A * | 4/1919 | Edwards | 220/252 |
| 1,334,908 | A * | 3/1920 | Kinzel | 220/832 |
| 1,655,798 | A * | 1/1928 | Richards | 108/9 |
| 3,135,427 | A | 6/1964 | Siegburg | |
| 3,272,379 | A * | 9/1966 | Driza et al. | 220/832 |
| 3,737,066 | A * | 6/1973 | Ames | 220/350 |
| 4,032,037 | A | 6/1977 | Dubery | |
| 4,736,982 | A * | 4/1988 | Hwang | 297/118 |
| 4,898,381 | A * | 2/1990 | Gordon | 482/103 |
| 5,011,036 | A | 4/1991 | Souza et al. | |
| 5,178,320 | A | 1/1993 | Bertone | |
| 5,218,784 | A | 6/1993 | Pollock | |
| 5,676,079 | A * | 10/1997 | Depke | 114/162 |
| 5,829,426 | A * | 11/1998 | Cloutier | 126/41 R |
| 5,992,632 | A | 11/1999 | Karren | |
| 6,003,705 | A | 12/1999 | Burguieres, Jr. | |

OTHER PUBLICATIONS

Notification of Transmittal of the International Search Report and the Written Opinion of the International Searching Authority or the Declaration for International Application PCT/US2007/004749, dated Jul. 31, 2007, (3 pages).

(Continued)

*Primary Examiner* — Anthony Stashick
*Assistant Examiner* — James N Smalley
(74) *Attorney, Agent, or Firm* — Osha Liang LLP

(57) ABSTRACT

Embodiments disclosed herein provide an apparatus that includes a container configured to store and transport drilling waste, a lid coupled to the container, and at least one arm coupled to the lid and configured to lift or lower the lid when moved, wherein the at least one arm comprises a counterweight. Disclosed embodiments also provide a method of opening and closing an apparatus. The method includes moving at least one arm coupled to a lid of the apparatus to an open position, wherein the apparatus is configured to store and transport drilling waste, disposing drilling waste in the apparatus, and moving the at least on arm coupled to the lid of the apparatus to a closed position. Disclosed embodiments also provide a method of modifying a mud skip that includes coupling at least one arm to a lid of the mud skip configured to store and transport drilling waste, wherein the at least one arm comprises a counterweight.

17 Claims, 8 Drawing Sheets

(56) References Cited

OTHER PUBLICATIONS

Written Opinion of the International Searching Authority dated Jul. 31, 2007 for International Application No. PCT/US2007/004749, (4 pages).
International Search Report dated Jul. 31, 2007 for International Application No. PCT/US2007/004749, (3 pages).
Official Action issued in related Eurasian Patent Application No. 200870313; dated Feb. 8, 2010 (4 pages).
Examiner's Report issued in related Canadian Patent Application No. 2,643,266; Dated Aug. 20, 2010 (2 pages).
Official Action issued in corresponding Eurasian Patent Application No. 200870313 with English Language translation; Dated Dec. 24, 2010 (2 pages).
Office Action issued in corresponding Mexican Patent Application No. MX/a/2008/011095 with English languge communication reporting the same; Dated May 31, 2011 (8 pages).
Office Action issued in corresponding Mexican Patent Application No. MX/a/2008/011095 with English languge communication reporting the same; Dated Nov. 8, 2011 (8 pages).
Office Action issued in corresponding Mexican Patent Application No. MX/a/2008/011095 with English language communication reporting the same; Dated Oct. 16, 2012 (11 pages).
Official Action issued in corresponding Eurasian Application No. 200870313/31 dated Apr. 18, 2013 (2 pages).
Office Action issued in corresponding European Application No. 07751505.4 dated Apr. 23, 2013 (7 pages).
Extended European Search Report issued in corresponding European Application No. 07751505.4; Dated Apr. 3, 2012 (12 pages).

* cited by examiner

COUNTERWEIGHTED CONTAINER LATCH

CROSS-REFERENCE TO RELATED APPLICATIONS

This application, pursuant to 35 U.S.C. §119(e), claims priority to U.S. Provisional Application Ser. No. 60/778,787, filed Mar. 3, 2006. That application is incorporated by reference in its entirety.

BACKGROUND OF INVENTION

1. Field of the Invention

Embodiments disclosed herein relate generally to containers for storing and transporting drilling waste. More specifically, the present invention relates to skips for storing and transporting drill cuttings and substances produced in the course of offshore drilling operations.

2. Background Art

FIG. 1 shows a typical offshore drilling rig 100 having a derrick 102, a floating platform 104, and a riser 106 that extends from the offshore drilling rig 100 down to the seabed 110. In drilling operations, particularly in the drilling of oil and gas wells large amounts of waste material is generated when drilling a wellbore 108 in an earth formation. The waste material generated is also known as drill cuttings. Drill cuttings may comprise, for example, rock, dirt, shale, and other debris. Drilling fluid ("drilling mud") is often pumped downhole for a number of different purposes, such as lubrication of the drill string within the riser 106, prevention of corrosion, and transport of drill cuttings to the surface. Drilling fluid may be oil or water-based, although oil-based drilling fluids are preferred in lower sections of bore, and are also generally less costly than water-based drilling fluids.

Once the drilling fluid is returned to the surface, it is passed through screens, vibratory separators, or other filtering arrangements to separate the waste material and drill cuttings from the drilling fluid. The drilling fluid may then be sent to a reservoir or returned to the system and reused. Drilling cuttings processed by filtering arrangements may contain approximately 10% to 20% moisture (oil, water) by weight. Because the waste material and drill cuttings contain contaminants, such as chemicals, hydrocarbons such as oil and other components hazardous to the environment, environmental regulations require that the waste material and drill cuttings be processed and disposed of in an environmentally acceptable manner. Contaminated waste material and drill cuttings recovered from an offshore drilling rig typically require removal from the rig or wellbore for treatment on land to decontaminate them before they can be safely disposed.

The waste material and drill cuttings are collected and stored on the drilling platform 114 or vessel in small containers, also known as mud skips, skips, or cuttings boxes, before being transported onshore for processing. The skips may be lifted by a crane 112 and loaded on a ship 116, or supply boat, for transportation to a shore base facility. The skips typically have about a five ton capacity and a typical drilling operation may produce up to 800 ton of drilling waste. Many skips are necessary on a typical drilling rig to handle the large amounts of drill cuttings generated. Dedicated crews are necessary to handle the skips on the drilling and at the shore base facility, cleaning crews are necessary to clean the skips after each use, and crews are needed to address safety and environmental concerns in each operation handling the skips.

FIGS. 2 and 3 show examples of typical mud skips 220 having a lid 222 coupled to the top 224 of the tank 220. A plurality of lifting eyes 228 are coupled to the tank 220. The lifting eyes 228 are configured to receive a hook (not shown) for lifting the tank 220 with a crane 112 (FIG. 1). Additionally, the tank 220 has slots 230 that allow the tank 220 to be lifted or transported by, for example, a forklift. The lid 222 is coupled to the top 224 of the tank 220 by one or more hinges 226 (also shown in FIG. 4). As shown in FIGS. 3 and 5, the lid 222 is manually opened by standing on the top 224 of the skip 220 and lifting on the on the side 230 opposite the hinged 226 side.

As shown in FIG. 6, after the lid 222 on the skip 220 is manually opened, waste material and drill cuttings separated from the drilling fluid are discharged from a separator 232 into the skip 220. The separator 232 may be disposed in a structure 234 that allows the separator to be positioned above the skip 220. Once the skip 220 is full, as viewed through, for example, a portal 236 disposed on the top 224 of the skip 220, the lid 222 may be closed and moved to a storage location on the drilling platform 114 (FIG. 1) or to a ship 116 (FIG. 1) for transportation onshore. Corresponding locks 238 on the lid 222 and the top 224 of the skip 220 secure the lid in the locked position to prevent leaks or spills of the drill cuttings during transportation.

Typically, mud skips for offshore drilling rigs range in size from 15 barrel (bbl) containers to 25 bbl containers. The skips may be comprised of galvanized steel that is internally coated for corrosion resistance. A skip, when empty, may range in weight from approximately 3000 lbs (1300 kg) to 4500 lbs (2000 kg) or more. The size of a skip may also vary based on the space available on a drilling platform for storage and the amount of drill cuttings produced. For example, a skip may vary in size from approximately 7.5 ft long by 4.5 ft wide by 4 ft high to 8 ft long by 8 ft wide by 4 ft high or larger. Accordingly, the gross total weight and capacity of each skip varies due to the variation in empty weight and size of the skip. The lids of the skips are also extremely heavy so as to provide a greater seal of the skip opening. Typically, a lid may weigh several hundred pounds or more. The heavy weight of the lids and the position of the operator atop the skip often present a safety concern for personnel when opening and closing the lids. Further, the lids are typically only safely secured in a fully open or fully closed position.

Accordingly, there exists a need to effectively and safely seal and store drill cuttings and waste material in mud skips.

SUMMARY OF INVENTION

In one aspect, embodiments disclosed herein relate to an apparatus comprising a container configured to store and transport drilling waste, a lid coupled to the container, and at least one arm coupled to the lid and configured to lift or lower the lid when moved, wherein the at least one arm comprises a counterweight.

In another aspect, embodiment disclosed herein relate to a method of opening and closing an apparatus, the method comprising moving at least one arm coupled to a lid of the apparatus to an open position, wherein the apparatus is configured to store and transport drilling waste, disposing drilling waste in the apparatus, and moving the at least one arm coupled to the lid of the apparatus to a closed position.

In another aspect, embodiments disclosed here relate to a method of modifying a mud skip, the method comprising coupling at least one arm to a lid of the mud skip configured to store and transport drilling waste, wherein the at least one arm comprises a counterweight.

Other aspects and advantages of the invention will be apparent from the following description and the appended claims.

DETAILED DESCRIPTION

In one aspect, embodiments disclosed herein relate to a storage container for drilling waste. In particular, disclosed embodiments provide an arm coupled to a lid of a mud skip for moving and securing the lid. Additionally, disclosed embodiments provide a method for modifying a mud skip to include an arm for moving and securing the lid of a mud skip. In one embodiment, an arm coupled to the lid of the mud skip allows the operator to open and close the lid while standing beside the mud skip. In one embodiment, the arm comprises a counterweight that reduces the amount of force or weight necessary to move the heavy lids open or closed. In another embodiment, the arm, in conjunction with an arm lock, secures the lid in open or closed positions by varying increments. Accordingly, embodiments of the present invention provide a safer and more effective mud skip.

Figure 1:
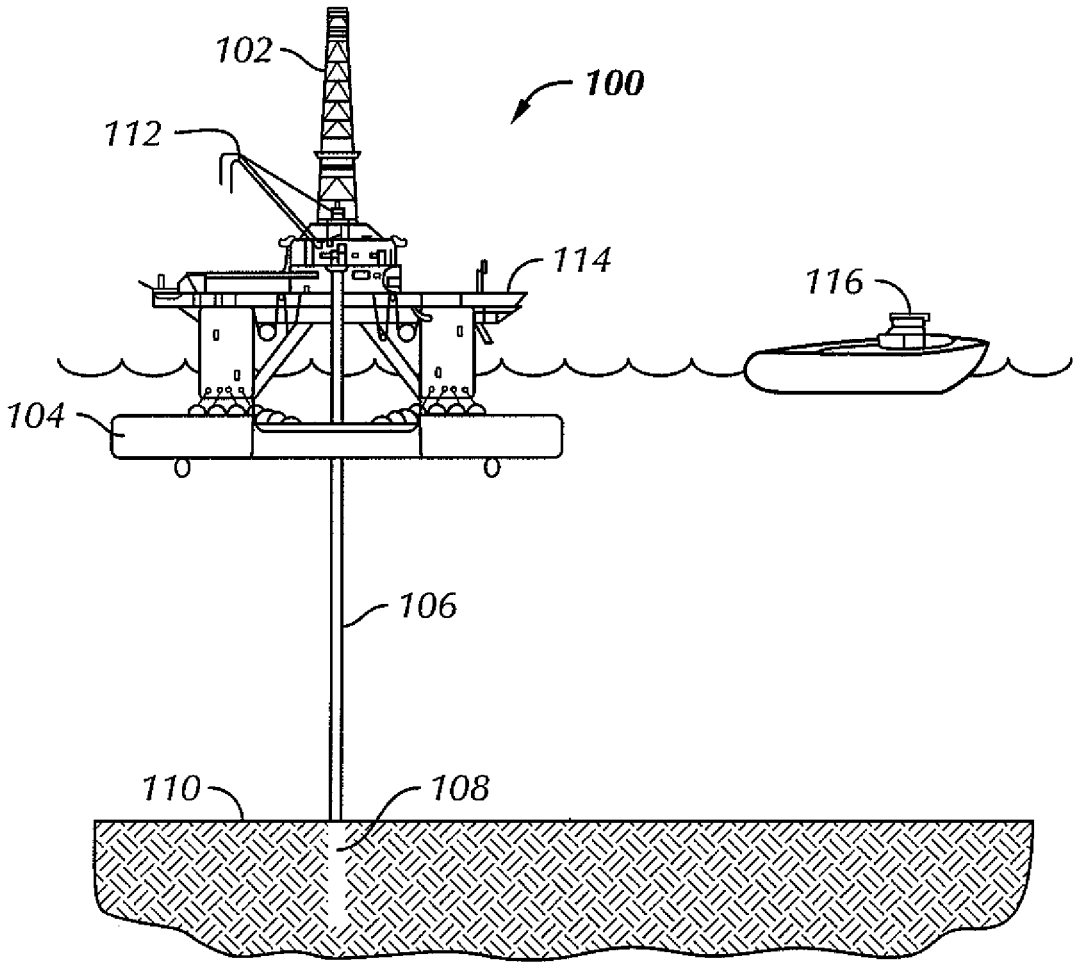
FIG. 1 (Prior Art)
FIG. 1 shows a conventional offshore drilling rig.
Figure 2:
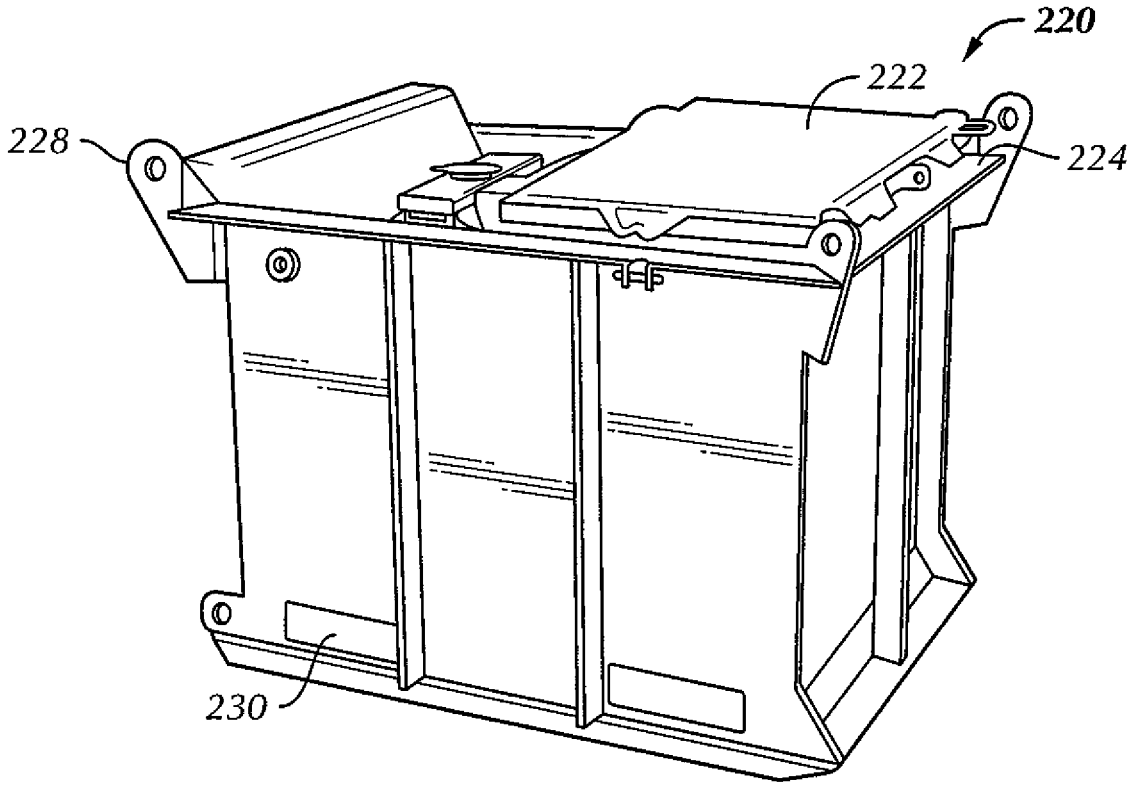
FIG. 2 (Prior Art)
FIG. 2 shows a conventional mud skip.
Figure 3:
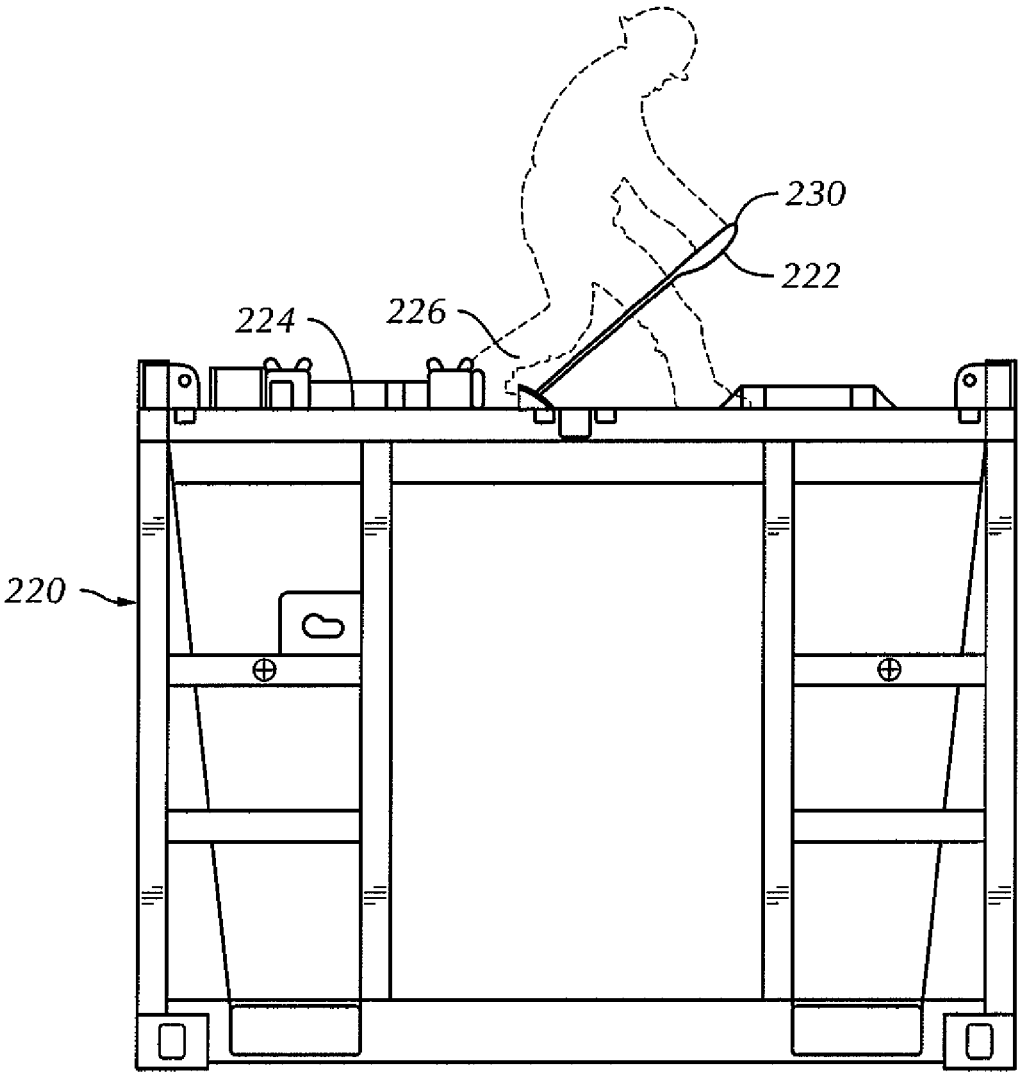
FIG. 3 (Prior Art)
FIG. 3 shows another conventional mud skip.
Figure 4:
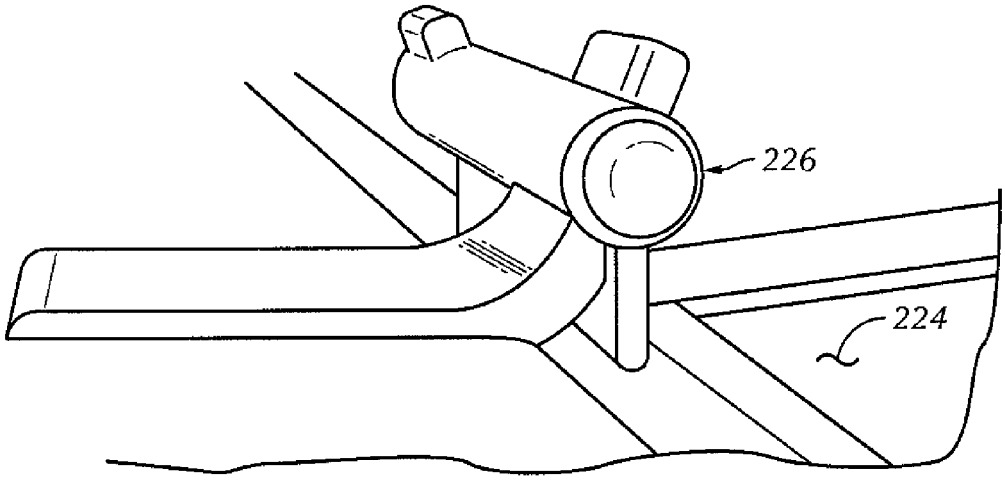
FIG. 4 shows a hinge of lid of a mud skip.
Figure 5:
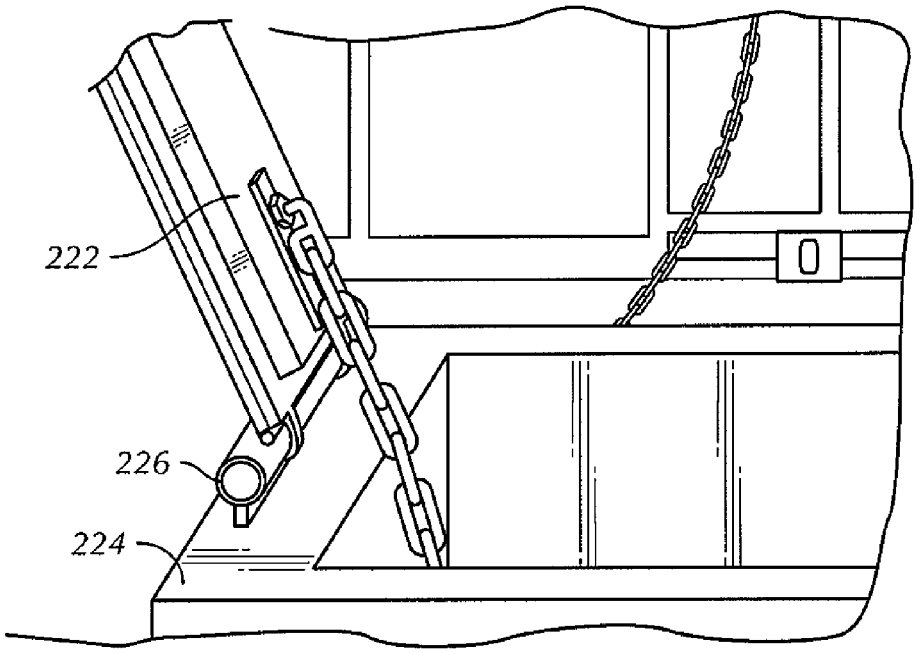
FIG. 5 shows a hinged lid of a mud skip.
Figure 6:
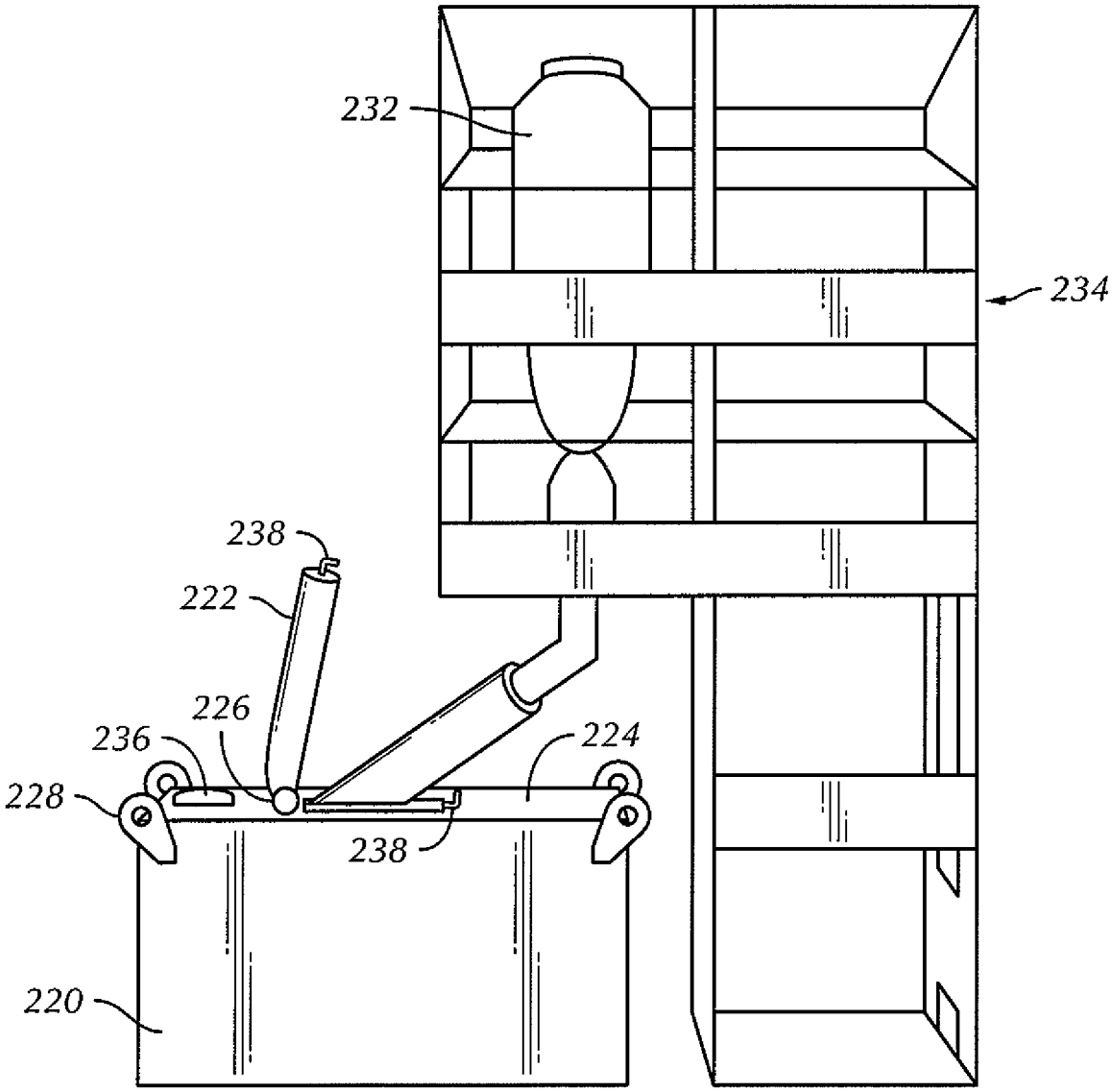
FIG. 6 shows a conventional mud skip being filled.
Figure 7:
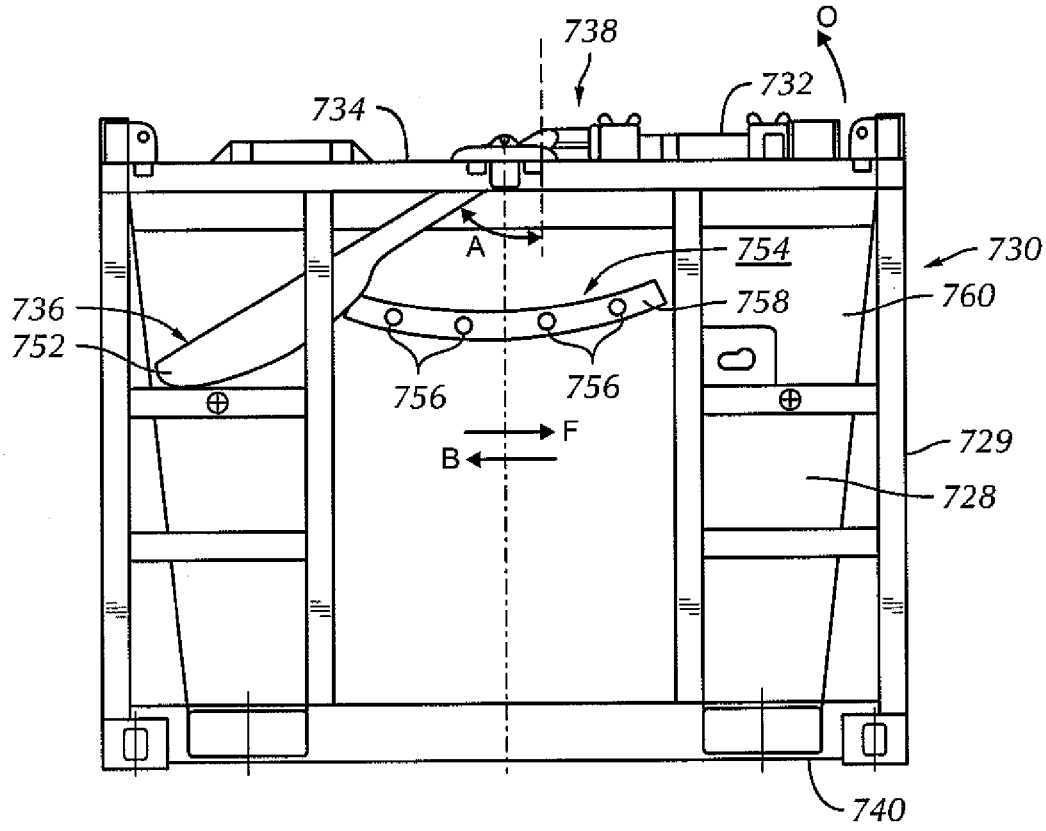
FIG. 7 shows a side view of a mud skip in accordance with an embodiment of the invention.
Figure 8:
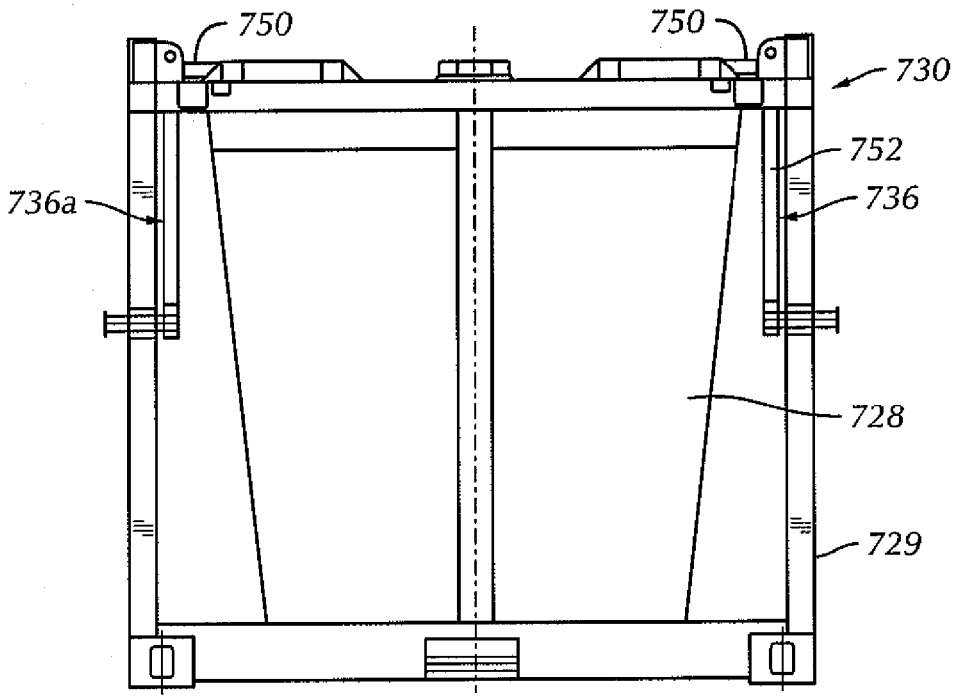
FIG. 8 shows a front view of a mud skip in accordance with an embodiment of the invention.
Figure 9:
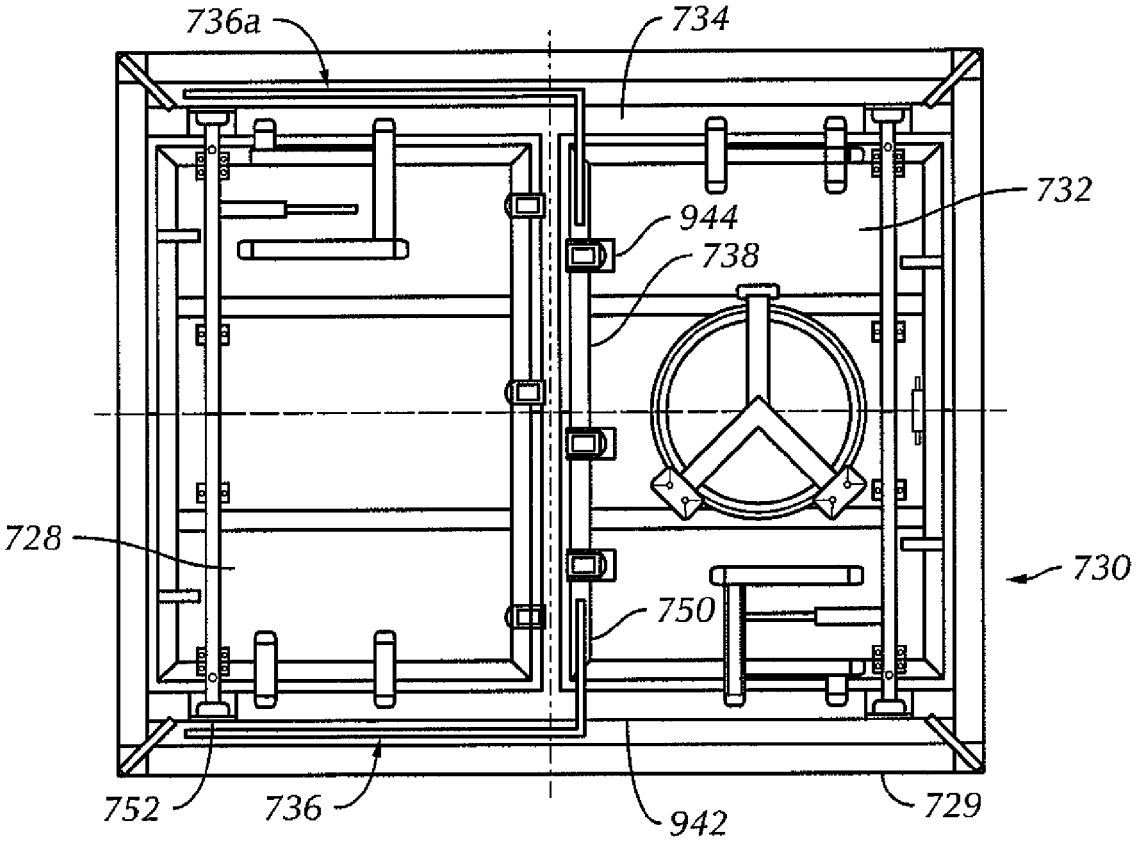
FIG. 9 shows a top view of a mud skip in accordance with an embodiment of the invention.

FIGS. 7-9 show an embodiment of a mud skip 730. The mud skip 730 comprises a container 728 and a frame 729 that provides support and mobility to the mud skip 730. A lid 732 is coupled to the top 734 of the mud skip 730. The container 728 and the lid 732 may be formed from any material known in the art for forming containers for storing drilling waste. For example, in one embodiment, the container 728 and the lid 732 may be formed of galvanized steel. Further, the container 728 may be internally coated with a corrosion resistant material. The lid 732 may be coupled by any means known in the art.

For example, at least one hinge 944 (FIG. 9) may couple the lid 732 to the top 734 of the mud skip 730. At least one arm 736, or lid key, is coupled to the lid 732 on the hinged side 738 of the lid 732. A second arm 736*a* may be coupled to the lid 732 of the mud skip 730 on the side opposite the arm 736 and oriented in a similar manner as arm 736.

The arm 736 may be coupled to the lid 732 by any method known in the art for safely securing two load bearing pieces together. For example, in one embodiment the at least one arm 736 may be bolted to the lid 732. Alternatively, the at least one arm 736 may be welded to the lid 732. In yet another embodiment, the at least one arm 736 may be releasably coupled to the lid 732. In this embodiment, the at least one arm 736 may be coupled to the lid 732 to lift or lower the lid 732 and then released and removed from the lid 732 when not in use. In this example, the at least one arm 736 used to lift and lower the lid 732 of a first mud skip may be removed and used to lift and lower a lid of a second mud skip. Additionally, the releasable coupling of the at least one arm 736 with the lid 732 allows the operator to remove the at least one arm 736 from lid 732 of the mud skip 730 to prevent interference of or damage to the arm 736 when mud skips are transported or stacked on top of one another.

The at least one arm 736 may comprise at least two sections 750, 752 (shown in FIG. 8) that may be integrally or separately formed, so long as the first section 750 and the second section 752 form a rigid junction. In the embodiment shown in FIGS. 7, 8, and 9, the first section 750 of the at least one arm 736 extends out laterally from the mud skip 730 along the axis of the hinged side 738 of the lid 732 and past the outer side edge 942 of the container 728. The second section 752 of the at least one arm 736 extends downwardly towards the base 740 of the mud skip 730. One of ordinary skill in the art will appreciate that the at least one arm 736 may be formed so that a first section extends across the width of the lid 732 past both sides of the container and two side sections may be disposed on either side of the container and formed in the same manner as the second section 752 of the at least one arm 736. The second section 752 may extend downwardly at an angle "A" defined between the axis of the second section 752 of the at least one arm 736 and an axis formed perpendicular to the axis of the first section 750 of the at least one arm 736. In one embodiment, angle A may be between 0 and 90 degrees. For example, when the lid 732 is in the closed position, the second section 752 of the at least one arm 736 may extend downwardly at an angle A of approximately 50 degrees.

In one embodiment, the second section 752 of the at least one arm 736 may comprise a counterweight that accounts for the weight of the lid 732. In this embodiment, the weight of the counterweight is such that when the second section 752 of the at least one arm 736 is moved forward, as indicated at F, the lid 732 may be lifted open, indicated at O. Accordingly, the second section 752 may be moved backward, indicated at B, to close the lid 732. In one embodiment, the counterweight may be integrally formed with the second section 752. For example, the second section 752 of the at least one arm 736 may be formed of a dense material in a selected size and shape, thereby providing sufficient weight to reduce the force or weight required to open the lid 732. The arm 736 may be formed of any material known in that art such that the arm may withstand the weight and movement of the lid 732. Alternatively, additional masses or weights may be coupled to the second section 752 of the at least one arm to provide sufficient weight to reduce the force or weight required to open the lid 732.

Figure 10:
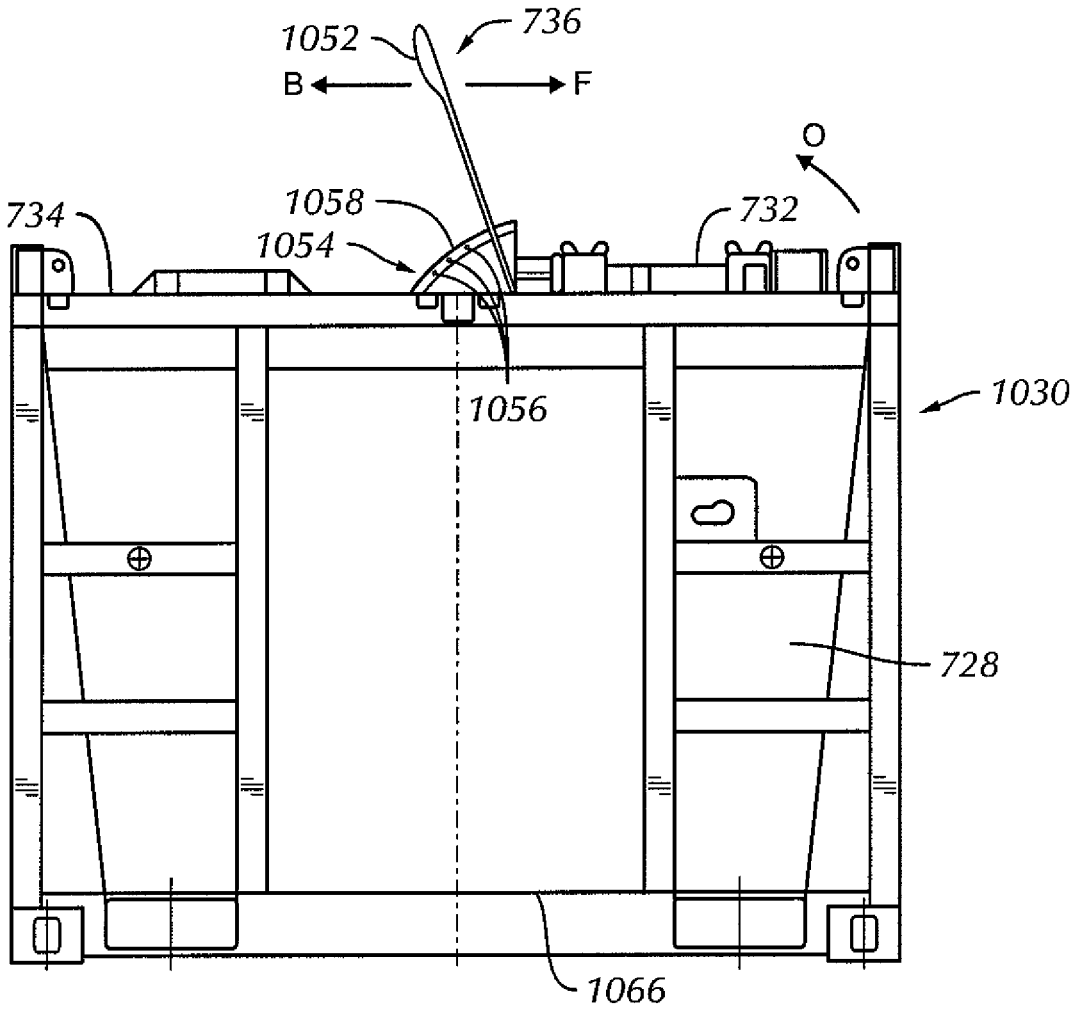
FIG. 10 shows a side view of a mud skip in accordance with an embodiment of the invention.

In an alternative embodiment, a second section 1052 of the at least one arm 736 may extend upwardly away from the base 740 of the mud skip 730, as shown in FIG. 10. In this embodiment, the second section 1052 of the at least one arm 736 may be moved backward, indicated at B, thereby moving the lid 732 open, indicated at O. To close the lid 732, the second section 1052 may be moved forward, indicated at F. In this embodiment, at least one groove or notch (not shown) may be formed on the bottom 1066 of the container 728 to accommodate the upwardly extending second section 1052 of the at least one arm 736 when multiple skips are stacked on top of one another. The second section 1052 disposed in the groove of a skip stacked on top of the mud skip 1030 may also prevent the stacked skip from moving or sliding off of the base skip 1030. Alternatively, the at least one arm 736 may be releasably coupled to the lid 732 and removed when stacking or transporting mud skips.

In this alternative embodiment, the second section 1052 of the at least one arm 736 may comprise a counterweight that accounts for the weight of the lid 732. In this embodiment, the weight of the counterweight is such that when the second section 1052 of the at least one arm 736 is moved backward, as indicated at B, the lid 732 may be lifted open, indicated at O. Accordingly, the second section 1052 may be moved forward, indicated at F, to close the lid 732. In one embodiment, the counterweight may be integrally formed with the second section 1052. For example, the second section 1052 of the at least one arm 736 may be formed of a dense material in a selected size and shape, thereby providing sufficient weight to reduce the force or weight required to open the lid 732. The arm 736 may be formed of any material known in that art such that the arm may withstand the weight and movement of the lid 732. Alternatively, additional masses or weights may be coupled to the second section 1052 of the at least one arm to provide sufficient weight to reduce the force or weight required to open the lid 732.

FIGS. 7-9 show an embodiment of the mud skip 730 further comprising an arm lock 754. In this embodiment, at least one arm 736 may be engaged with the arm lock 754 at pre-selected locations, thereby securing the lid 732 open or closed at corresponding varying increments. In one embodiment, the arm lock 754 may comprise a plate 758 coupled to the outer side wall 760 of the container 728. In this embodiment, several locking holes 756, for example, threaded holes, may be formed in the plate 758 so as to provide pre-selected locking locations. As at least one arm 736 is moved forward F, the operator may lock the at least one arm 736 into a selected location 756 by securing a locking device (not shown), for example, a bolt, screw, or other similar structure, through the arm 736 and into the location 756, thereby securing the lid 732 open or closed at a corresponding increment. In this embodiment, the plate 758 may be curved so as to maintain alignment with the locking device coupled to the arm 736. One of ordinary skill will appreciate that other arm locks coupled to the at least one arm 736 for securing the at least one arm 736 at pre-selected locations, thereby securing the lid 732 open or closed at varying increments may be used without departing from the scope of the invention.

Similarly, FIG. 10 shows an embodiment of the mud skip 1030 further comprising an arm lock 1054. In this embodiment, at least one arm 736 may be engaged with the arm lock 1054 at pre-selected locations, thereby securing the lid 732 open or closed at corresponding varying increments. In one embodiment, the arm lock 1054 may comprise a plate 1058 coupled to the top 734 of the container 728. In this embodiment, several locking holes 1056, for example, threaded holes, may be formed in the plate 1058 so as to provide pre-selected locking locations. As at least one arm 736 is moved backward B, the operator may lock the at least one arm 736 into a selected location 1056 by securing a locking device (not shown), for example, a bolt, screw, or other similar structure, through the arm 736 and into the location 1056, thereby securing the lid 732 open or closed at a corresponding increment. In this embodiment, the plate 1058 may be curved so as to maintain alignment with the locking device coupled to the arm 736. One of ordinary skill will appreciate that other arm locks coupled to the at least one arm 736 for securing the at least one arm 736 at pre-selected locations, thereby securing the lid 732 open or closed at varying increments may be used without departing from the scope of the invention.

Typically, an operator must stand on top of the mud skip 730 to lift the lid 732. To lift the lid it may take 140 lbs (65 kg) of weight or more, as may be determined by a mechanical suspended scale. In contrast, embodiments disclosed herein, for example, shown in FIGS. 7-9, allow the operator to stand next to the mud skip 730 and push at least one arm 736 forward to lift the lid 732 open with less force or weight than required to lift the lid separately. For example, wherein the weight of the lid 732 would typically require 140 lbs (65 kg) to lift in the conventional manner, in the embodiment shown in FIG. 7, the weight required to move the arm 736 forward, and thereby open the lid 732, is approximately 10 lbs (5 kg). In another embodiment, two operators may be positioned on opposite sides of the mud skip 730 and each push an arm 736, **736*a* forward, thereby lifting the lid 732 open and reducing the force or weight necessary to lift the lid 732**.

Embodiments of the present invention may advantageously provide a mud skip with an arm for lifting a lid of the mud skip. Embodiments of the present invention may reduce the risk of injury to personnel while operating mud skips. Further, embodiments of the invention allow for a more securely positioned lid, in both the open and closed positions. Embodiments of the present invention may prevent movement of skips when multiple skips are stacked.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. An apparatus comprising:

a container configured to store drilling waste;

a lid coupled to the container; and at least one arm comprising a counterweight, a first section, and a second section, the at least one arm coupled to the lid and configured to lift or lower the lid when moved, wherein the at least one arm extends outwardly and upwardly beyond a top of the container and a top of the lid, wherein the container is configured to be stacked with a second container and configured to receive a second arm of a second container, and wherein the container includes a groove formed on a bottom surface of the container for receiving the second arm of the second container.

2. The apparatus of claim 1, wherein the at least one arm is coupled to a hinged side of the lid.

3. The apparatus of claim 1, wherein the at least one arm extends outwardly and downwardly over a side of the container in an alternate position.

4. The apparatus of claim 3, wherein the at least one arm is configured to lift the lid open when moved forward.

5. The apparatus of claim 1, wherein the counterweight is integrally formed with the at least one arm.

6. The apparatus of claim 1, wherein the counterweight is separately formed and coupled to the at least one arm.

7. The apparatus of claim 1, further comprising at least one arm lock for securing the at least one arm in at least one pre-selected location, wherein the at least one arm lock comprises a plate having locking holes disposed at the at least one pre-selected location.

8. The apparatus of claim 7, further comprising a locking device that secures the at least one arm in the pre-selected location.

9. The apparatus of claim 1, wherein the at least one arm is bolted to the lid.

10. The apparatus of claim 1, wherein the at least one arm is welded to the lid.

11. The apparatus of claim 1, wherein the at least one arm is releasably coupled to the lid.

12. The apparatus of claim 1, wherein the container is a waste container.

13. The apparatus of claim 12, wherein the waste container is a mud skip.

14. A method of using the apparatus of claim 1 comprising:

providing a first container, the first container configured to be stacked with a second container;

stacking the first container onto the second container, wherein the first container is configured to receive an upwardly extending second arm of the second container, and wherein the first container includes a groove formed on a bottom surface of the first container for receiving the upwardly extending second arm of the second container.

15. The apparatus of claim 1, wherein the second section comprises the counterweight.

16. The method of claim 14, further comprising decoupling the upwardly extending second arm from a lid of the second container prior to the stacking; and re-coupling the upwardly extending second arm to the lid after the coupling.

17. An apparatus comprising:

a container configured to store drilling waste;

a lid coupled to the container; and at least one arm comprising a counterweight, a first section, and a second section, the at least one arm coupled to the lid and configured to lift or lower the lid when moved, wherein the at least one arm extends outwardly and upwardly beyond a top of the container and a top of the lid; and wherein the container is configured to be stacked with a second container and configured to receive a second arm of a second container, the second container configured to store drilling waste, the second container comprising:

a second lid coupled to the second container; and the second arm of the second container comprising a second counterweight, a first section, and a second section, the second arm coupled to the second lid and configured to lift or lower the second lid when moved, wherein the second section of the second arm extends outwardly and upwardly beyond a top of the second container and a top of the second lid, and into the groove formed on the bottom of the container when the container and the second container are stacked.

* * * * *